US005283006A

United States Patent [19]

Lehrer et al.

[11] Patent Number: 5,283,006

[45] Date of Patent: Feb. 1, 1994

[54] NEUTRALIZING AMINES WITH LOW SALT PRECIPITATION POTENTIAL

[75] Inventors: Scott E. Lehrer, Houston; James G. Edmondson, Conroe, both of Tex.

[73] Assignee: Betz Laboratories, Inc., Trevose, Pa.

[21] Appl. No.: 982,803

[22] Filed: Nov. 30, 1992

[51] Int. Cl.[5] ..... C23F 11/14

[52] U.S. Cl. ..... 252/392; 208/207; 208/236; 208/48 AA; 208/47; 422/16; 210/698

[58] Field of Search ..... 208/207, 236, 47, 48 AA, 208/4 AA; 422/16; 252/392, 394; 210/698

[56] References Cited

U.S. PATENT DOCUMENTS

| | | | |
|---|---|---|---|
| 2,797,188 | 6/1957 | Taylor, Jr. et al. | 208/236 |
| 2,913,406 | 11/1959 | Hoover | 208/236 |
| 3,472,666 | 10/1969 | Foroulis | 106/14 |
| 3,779,905 | 12/1973 | Stedman | 208/348 |
| 3,860,430 | 1/1975 | Walker et al. | 252/392 |
| 3,981,780 | 9/1976 | Scherrer et al. | 203/7 |
| 4,062,764 | 12/1977 | White et al. | 208/348 |
| 4,430,196 | 2/1984 | Niu | 208/47 |
| 4,511,453 | 4/1985 | Baumert et al. | 208/8 LE |
| 4,569,750 | 2/1986 | Brownawell et al. | 208/48 AA |
| 4,806,229 | 2/1989 | Ferguson et al. | 208/47 |
| 4,808,765 | 2/1989 | Pearce et al. | 208/236 |
| 5,094,814 | 3/1992 | Soderquist et al. | 422/16 |

*Primary Examiner*—Robert L. Stoll
*Assistant Examiner*—Valerie Fee
*Attorney, Agent, or Firm*—Alexander D. Ricci; Gregory M. Hill

[57] ABSTRACT

A method for neutralizing acidic species and inhibiting the deposition of amine acid salts on the internal surfaces of elevated temperature processing units in a petroleum refinery comprising adding to the hydrocarbon liquid being processed therein a tertiary amine, including trimethylamine and triethylamine.

10 Claims, No Drawings

NEUTRALIZING AMINES WITH LOW SALT PRECIPITATION POTENTIAL

FIELD OF THE INVENTION

The present invention relates to the refinery processing of crude oil. Specifically, it is directed toward the problem of corrosion of refinery equipment caused by corrosive elements found in the crude oil.

BACKGROUND

Hydrocarbon feedstocks such as petroleum crudes, gas oil, etc. are subjected to various processes in order to isolate and separate different fractions of the feedstock. In refinery processes, the feedstock is distilled so as to provide light hydrocarbons, gasoline, naphtha, kerosene, gas oil, etc.

The lower boiling fractions are recovered as an over head fraction from the distillation column. The intermediate components are recovered as side cuts from the distillation column. The fractions are cooled, condensed, and sent to collecting equipment. No matter what type of petroleum feedstock is used as the charge, the distillation equipment is subjected to the corrosive activity of acids such as $H_2S$, HCl, organic acids, and $H_2CO_3$.

Corrosive attack on the metals normally used in the low temperature sections of a refinery process system, (i.e. where water is present below its dew point) is an electrochemical reaction generally in the form of acid attack on active metals in accordance with the following equations:

(1) at the anode $$Fe(s) \rightarrow Fe^{++} + 2e^-$$

(2) at the cathode $$2H^+ + 2e^- 2H$$

$$2H \rightarrow H_2(g)$$

The aqueous phase may be water entrained in the hydrocarbons being processed and/or water added to the process for such purposes as steam stripping. Acidity of the condensed water is due to dissolved acids in the condensate, principally HCl, organic acids, $H_2S$, and $H_2CO_3$. HCl, the most trouble some corrosive material, is formed by hydrolysis of calcium and magnesium chlorides originally present in the brines.

Corrosion may occur on the metal surfaces of fractionating towers such as crude towers, trays within the towers, heat exchangers, etc. The most troublesome locations for corrosion are tower top trays, overhead lines, condensers, and top pump around exchangers. It is usually within these areas that water condensate is formed or carried along with the process stream. The top temperature of the fractionating column is usually, but not always, maintained at about or above the dew point of water. The aqueous condensate formed contains a significant concentration of the acidic components above-mentioned. These high concentrations of acidic Components render the pH of the condensate highly acidic and, of course, dangerously corrosive. Accordingly, neutralizing treatments have been used to render the pH of the condensate more alkaline to thereby minimize acid-based corrosive attack at those regions of the apparatus with which this condensate is in contact.

One of the chief points of difficulty with respect to corrosion occurs above and in the temperature range of the initial condensation of water. The term "initial condensate" as it is used herein signifies a phase formed when the temperature of the surrounding environment reaches the dew point of water. At this point a mixture of liquid water, hydrocarbon, and vapor may be present. Such initial condensate may occur within the distilling unit itself or in subsequent condensors. The top temperature of the fractionating column is normally maintained above the dew point of water. The initial aqueous condensate formed contains a high percentage of HCl. Due to the high concentration of acids dissolved in the water, the pH of the first condensate is quite low. For this reason, the water is highly corrosive. It is important, therefore, that the first condensate be rendered less corrosive.

In the past, highly basic ammonia has been added at various points in the distillation circuit in an attempt to control the corrosiveness of condensed acidic materials. Ammonia, however, has not proven to be effective with respect to eliminating corrosion occurring at the initial condensate. It is believed that ammonia has been ineffective for this purpose because it does not condense completely enough to neutralize the acidic components of the first condensate.

At the present time, amines such as morpholine and methoxypropylamine (U.S. Pat. No. 4,062,746) are used successfully to control or inhibit corrosion that ordinarily occurs at the point of initial condensation within or after the distillation unit. The addition of these amines to the petroleum fractionating system substantially raises the pH of the initial condensate rendering the material noncorrosive or substantially less corrosive than was previously possible. The inhibitor can be added to the system either in pure form or as an aqueous solution. A sufficient amount of inhibitor is added to raise the pH of the liquid at the point of initial condensation to above 4.5 and, preferably, to between 5.5 and 6.0.

Commercially, morpholine and methoxypropylamine have proven to be successful in treating many crude distillation units. In addition, other highly basic ($pKa > 8$) amines have been used, including ethylenediamine and monoethanolamine. Another commercial product that has been used in these applications is hexamethylenediamine.

A specific problem has developed in connection with the use of these highly basic amines for treating the initial condensate. This problem relates to the hydrochloride salts of these amines which tend to form deposits in distillation columns, column pumparounds, overhead lines, and in overhead heat exchangers. These deposits manifest themselves after the particular amine has been used for a period of time, sometimes in as little as one or two days. These deposits can cause both fouling and corrosion problems and are most problematic in units that do not use a water wash.

RELATED ART

Conventional neutralizing compounds include ammonia, morpholine, and ethylenediamine. U.S. Pat. No. 4,062,764 discloses that alkoxylated amines are useful in neutralizing the initial condensate.

U.S. Pat. No. 3,472,666 suggests that alkoxy substituted aromatic amines in which-the alkoxy group contains from 1 to 10 carbon atoms are effective corrosion inhibitors in petroleum refining operations. Representative examples of these materials are aniline, anisidine and phenetidines.

Alkoxylated amines, such as methoxypropylamine, are disclosed in U.S. Pat. No. 4,806,229. They may be used either alone or with the film forming amines of previously noted U.S. Pat. No. 4,062,764.

The utility of hydroxylated amines is disclosed in U.S. Pat. No. 4,430,196. Representative examples of these neutralizing amines are dimethylisopropanolamine and dimethylaminoethanol.

U.S. Pat. No. 3,981,780 suggests that a mixture of the salt of a dicarboxylic acid and cyclic amines are useful corrosion inhibitors when used in conjunction with traditional neutralizing agents, such as ammonia.

Many problems are associated with traditional treatment programs. Foremost is the inability of some neutralizing amines to condense at the dew point of water thereby resulting in a highly corrosive initial condensate. Of equal concern is the formation on metallic surfaces of hydrochloride or sulfide salts of those neutralizing amines which will condense at the water dew point. The salts appear before the dew point of water is reached and result in fouling and underdeposit corrosion, often referred to as "dry" corrosion.

Accordingly, there is a need in the art for a neutralizing agent which can effectively neutralize the acidic species at the point of the initial condensation without causing the formation of fouling salts with their corresponding "dry" corrosion.

DETAILED DESCRIPTION OF THE INVENTION

It has been discovered that tertiary amines, having the structure of Formula I, are effective acid corrosion inhibitors during elevated temperature processing in petroleum refineries.

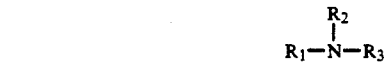

Formula I wherein $R_1$, $R_2$ and $R_3$ are independently $C_1$ to $C_6$ straight branched or cyclic alkyl radicals or $C_2$ to $C_6$ alkoxyalkyl or $C_3$ to $C_6$ hydroxyalkyl radicals, having a low molecular weight per amine functionality. Exemplary amines include trimethylamine, triethylamine, N,N-dimethyl-N-(methoxypropyl) amine, N,N-dimethyl-N-(methoxyisopropyl) amine, N,N-dimethyl-N-(2-hydroxy-2-methylpropyl) amine and N,N-dimethyl-N-(methoxyethyl) amine.

In this environment these amines exhibit the unique dual characteristics of neutralizing the acidic species present in the hydrocarbon while, at the same time, not allowing the formation of amine salt species on the internal surfaces of the overhead equipment of the distillation units until after water has begun to condense on the equipment surfaces.

The addition of the tertiary amine of Formula I to the distillation unit effectively inhibits corrosion on the metallic surfaces of petroleum fractionating equipment such as crude unit towers, the trays within the towers, heat exchangers, receiving tanks, pumparounds, overhead lines, reflux lines, connecting pipes, and the like. The amines may be added at any of these locations and would encompass incorporation into the crude charge, the heated liquid hydrocarbon stream or the vaporized hydrocarbon depending on the location of addition.

Certain tertiary amines, such as trimethylamine and triethylamine, have flash points below 100° F., even as dilute solutions in water, and are therefore very flammable. This makes handling and transportation of these chemicals under normal conditions very difficult and dangerous. It has been discovered that by adding a weak, volatile acid to such amines, it is possible to elevate their flashpoints to acceptable use levels. Carbon dioxide is most suitable for this purpose. The addition of carbon dioxide to these amines forms an amine bicarbonate solution which, when injected into the crude unit, will dissociate into the free amine and carbon dioxide. Since carbon dioxide is an extremely weak and volatile acid, it will not condense at the water dewpoint thereby not requiring additional demand for neutralizers. Carbon dioxide should be injected into the amine solution for a sufficient amount of time to lower the pH to less than 8.0. This represents about 75% neutralization and raises the flash point to between 100° and 110° F.

It is necessary to add a sufficient amount of tertiary amine of Formula I to neutralize acid corrosion causing species. These amines should idealy raise the pH of the initial condensate to 4.5 or more. The amount required to achieve this objective is from 0.1 to 1,000 ppm, by volume, based on the overhead hydrocarbon volume. The precise concentration will vary depending upon the amount of acidic species present in the crude.

These amines are particularly effective in systems where acid concentrations are high and where a water wash is absent. Systems without a water wash exhibit a lower dew point than systems which employ a water wash. The combination of high levels of acidic species and the absence of a water wash increase the likelihood of the amine salt depositing on overhead equipment before the initial dewpoint is reached. It is under these conditions that the use of the amines according to the present invention is most beneficial.

EXAMPLES

In order to demonstrate the unexpected advantages of the amines utilized according to this invention, a computer program was written which calculates the dewpoint for amine salts given the vapor pressure data and the operating conditions of a particular crude unit. Vapor pressure data for the salts of both conventional amines and those of the present invention were measured using an effusion procedure as described by Farrington, et. al., in *Experimental Physical Chemistry* (McGraw Hill, 19702 pp. 53–55) herein incorporated by reference. Amine concentrations were based on the feedrates required of conventional amines@t to neutralize the acids condensed in the specific unit.

Since it is well recognized that corrosion will occur on the internal surfaces of refinery equipment when amine salts condense above the temperature of the water dewpoint, the following calculations were made to show that the amine hydrochloride salts formed by use of the amines of the present invention condense below the temperature of the water dewpoint. These amines thus exhibit the required characteristics of being able to neutralize acidic species while not permitting the resulting amine salt to condense on equipment surfaces until after water has condensed.

EXAMPLE I

Operating conditions for a Louisiana refinery known to have experienced salt deposition problems were used to calculate amine salt dewpoints. Dewpoints were determined for conventional neutralizing amines and for an example of an amine according to the present invention. The acid used was HCl, the dominant acidic species present in this overhead unit. Calculations were based upon amine and hydrochloride molar concentrations representative of those found in the unit. The results of this analysis is shown in Table I.

TABLE I

AMINE HYDROCHLORIDE DEWPOINT CALCULATIONS FOR LOUISIANA REFINERY

| Conditions: | |
|---|---|
| Crude Charge | 228,000 BPD |
| Water in Crude | 0% |
| Overhead Naphtha Flow | 44,600 BPD |
| Stripping Stream: | 27,000 #/hr |
| Overhead Temperature: | 307° F. |
| Overhead Pressure: | 23 psig |
| Accumulator Temperature: | 114° F. |
| Accumulator Pressure: | 9 psig |
| 50% BP Overhead Naphtha: | 256° F. |
| API Gravity: | 65° |
| Water Dewpoint: | 225° F. |
| Chloride Concentration: | 30 ppm |

| Neutralizer | Feedrate (mg/l)* | Initial Salt Dewpoint (°F.) |
|---|---|---|
| Ethylene Diamine | 6.9 | 372 |
| Ethanolamine | 15.3 | 280 |
| Methoxypropylamine | 22.4 | 257 |
| Dimethylaminoethanol | 22.4 | 246 |
| Dimethylisopropanolamine | 25.9 | 228 |
| Trimethylamine | 14.9 | 194 |

*All neutralizer feedrates are equimolar amounts.

The above data show that only trimethylamine hydrochloride will not condense in the crude unit above the water dewpoint of 225° F. The hydrochloride salts of the other, conventionally utilized amines will, however, condense at temperatures above the water dewpoint thereby causing fouling and/or corrosion problems.

Experience in this unit with either ethylene diamine or methoxypropylamine as the neutralizer showed that fouling occurred. Salt deposition led to pressure buildup and as many as five water washes per week were required to alleviate the problem. Analyses of water wash samples showed very high concentrations of these conventional amines and $Cl^-$ which is indicative of salt fouling.

EXAMPLE II

The results cf salt dewpoint calculations for a California refinery subject to fouling are shown in Table II. Fouling at this refinery was indicated by a more gradual pressure buildup wit the conventional treatments using ammonia, methoxypropylamine, dimethylaminoethanol or dimethylisopropanol amine.

TABLE II

AMINE HYDROCHLORIDE DEWPOINT CALCULATIONS FOR CALIFORNIA REFINERY

| Conditions: | |
|---|---|
| Crude Charge | 57,00 BPD |
| Water in Crude | 0.4% |
| Overhead Naphtha Flow | 9,200 BPD |

TABLE II-continued

AMINE HYDROCHLORIDE DEWPOINT CALCULATIONS FOR CALIFORNIA REFINERY

| | |
|---|---|
| Stripping Stream: | 4,500 #/hr |
| Overhead Temperature: | 300° F. |
| Overhead Pressure: | 18 psig |
| Accumulator Temperature: | 110° F. |
| Accumulator Pressure: | 3 psig |
| 50% BP Overhead Naphtha: | 273° F. |
| API Gravity: | 55° |
| Water Dewpoint: | 240° F. |
| Chloride Concentration: | 60 ppm |

| Neutralizer | Feedrate (mg/l)* | Initial Salt Dewpoint (°F.) |
|---|---|---|
| Ethylene Diamine | 28.8 | 450 |
| Ethanolamine | 58.5 | 314 |
| Methoxypropylamine | 85.4 | 294 |
| Dimethylaminoethanol | 85.4 | 290 |
| Dimethylisopropanolamine | 98.9 | 252 |
| Trimethylamine | 56.7 | 216 |

*All neutralizer feedrates are equimolar amounts.

The above data again show that only the hydrochloride from the tertiary amine of Formula I will not condense in the crude unit above the water dewpoint of 240° F. The hydrochloride salts of the other, conventionally utilized amines, however, condensed at temperatures above the water dewpoint thereby causing fouling and corrosion problems.

What we claim is:

1. A method for preventing fouling cause by amine hydrochloride salts on the internal surfaces of the overhead equipment of a distillation unit in a petroleum refinery during processing of a hydrocarbon comprising adding to the distillation unit a tertiary amine selected from the group consisting of trimethylamine and triethylamine.

2. The method of claim 1 wherein from about 0.1 to 1000 ppm, by volume, based on the hydrocarbon volume is added.

3. The method of claim 1 wherein the tertiary amine is added to the vaporized hydrocarbon in the distillation unit.

4. The method of claim 1 further comprising blending a sufficient amount of a weak and volatile acid with the tertiary amine in order to lower the pH to less than about 8.0.

5. The method of claim 4 wherein the weak and volatile acid is carbon dioxide.

6. A method for inhibiting corrosion caused by amine hydrochloride salts on the internal surfaces of the overhead equipment of a distillation unit in a petroleum refinery during processing of a hydrocarbon comprising adding to the distillation unit a tertiary amine selected from the group consisting of trimethylamine and triethylamine.

7. The method of claim 6 wherein from about 0.1 to 1000 ppm, by volume, based on the hydrocarbon volume is added.

8. The method of claim 6 wherein the tertiary amine is added to the vaporized hydrocarbon in the distillation unit.

9. The method of claim 6 further comprising blending a sufficient amount of a weak and volatile acid with the tertiary amine in order to lower the pH to less than about 8.0.

10. The method of claim 9 wherein the weak and volatile acid is carbon dioxide.

* * * * *